United States Patent [19]

Vonlanthen

[11] Patent Number: 4,939,915

[45] Date of Patent: Jul. 10, 1990

[54] ELECTROMECHANICAL LOCKING DEVICE

[75] Inventor: Benno Vonlanthen, Zollikofen, Switzerland

[73] Assignee: R. Berchtold AG, Zollikofen, Switzerland

[21] Appl. No.: 278,944

[22] PCT Filed: Feb. 2, 1988

[86] PCT No.: PCT/CH88/00025

§ 371 Date: Oct. 4, 1988

§ 102(e) Date: Oct. 4, 1988

[87] PCT Pub. No.: WO88/05853

PCT Pub. Date: Aug. 11, 1988

[30] Foreign Application Priority Data

Feb. 9, 1987 [CH] Switzerland ..... 456/87

[51] Int. Cl.[5] ..... E05B 47/00

[52] U.S. Cl. ..... 70/277; 70/279

[58] Field of Search ..... 70/277–279, 70/408, 413, 409, DIG. 46

[56] References Cited

U.S. PATENT DOCUMENTS

| | | | |
|---|---|---|---|
| 3,336,770 | 8/1967 | Parsons | 70/277 X |
| 4,392,134 | 7/1983 | Lutz | 70/413 X |
| 4,761,976 | 8/1988 | Kleinhäny | 70/277 |
| 4,771,620 | 9/1988 | Kleinhäny | 70/277 |
| 4,798,068 | 1/1989 | Nakauchi | 70/277 X |
| 4,807,454 | 2/1989 | Sengupta et al. | 70/277 |
| 4,807,455 | 2/1989 | Mauer | 70/277 |
| 4,848,115 | 7/1989 | Clarkson et al. | 70/278 X |

FOREIGN PATENT DOCUMENTS

| | | | |
|---|---|---|---|
| 2428130 | 6/1978 | France . | |
| 2022678 | 12/1979 | United Kingdom . | |
| 2024922 | 1/1980 | United Kingdom | 70/277 |
| 2055951 | 3/1981 | United Kingdom . | |

*Primary Examiner*—Robert L. Wolfe
*Assistant Examiner*—Suzanne L. Dino
*Attorney, Agent, or Firm*—Tarolli, Sundheim & Covell

[57] ABSTRACT

An electromechanical cylinder lock (1) is connected with a key (2) which has electronic and mechanical codings. In the lock (1) are arranged and connected with each other electronic elements (55), a microswitch (56) and an electric coil (11) with a magnet anchor (12). The magnet anchor (12) is part of the blocking device (6) which, through a release bolt (13) and a holding pin (15), engages in the rotor (5) of the lock (1). Parallel with the release bolt (13) is arranged a blocking bolt (14) which engages, at one end, in the rotor (5), and at the other end, in the magnet anchor (12). For the opening of the lock, besides the mechanical blocking elements, the microswitch (56), the release bolt (13), the magnet anchor (12) and the blocking bolt (14) must also be brought into their correct positions.

17 Claims, 2 Drawing Sheets

ELECTROMECHANICAL LOCKING DEVICE

BACKGROUND OF THE INVENTION

1. Technical Field

The invention relates to an electromechanical locking device having a cylinder lock with a device for transmitting information signals between the lock and a key, a stator housing with a rotor rotatable in this housing, and a blocking device to prevent rotary movement of the rotor in the stator housing and the key.

2. Description of the Prior Art

The combining is known of cylinder locks with mechanically coded holding devices, and with an electromagnetic blocking device. In this way, the safety of the locking device is increased. Especially in bank and treasury equipment, the electromagnetic blocking device acts directly on the bolt of the lock, while they can usually be actuated by an electric or electronic control arranged independently of the mechanical key. Such systems are expensive and require a relatively great amount of installation space. Devices have also been developed in which the information is placed directly on the mechanical key and corresponding reading devices have been built into the cylinder lock to recognize the information signal. By means of the key, a rotor arranged inside the cylinder lock is rotatable, and the locking bolt is actuated by this rotary movement.

Such a locking device is known from German Disclosure No. 3,205,586. In this locking device, the key bears information in the form of magnetic coding. On the cylinder lock is arranged a corresponding reading device which receives the code pulses given off by the key and forwards them to a recognition device. This electronic recognition device is connected with an electromagnetic actuating device. Through a carrier pin, the electromagnetic actuating device can connect the rotor in rotary connection with the element actuating the bolt. This bolt-actuating element is arranged at right angles to the axis of the lock and projects out of the lock cylinder. To produce the necessary forces and lengths of movement of the carrier pin, stable and relatively strong magnets are necessary, by which the outer dimensions of the cylinder lock are much greater than those of locks normally used. Therefore, it is impossible to install such locking devices in doors or equipment already present, without rebuilding them or making fundamental changes. In this known device, the information signals are transmitted by turning the key. Then, if the information agrees with the pulse sequence already in the lock, the rotor is coupled with the bolt-actuating element. Also, this design does not correspond to the known mechanical cylinder locks often used today, and it cannot be seen how this principle could be transferred to these.

The problems of the electromagnets and actuating pins arranged perpendicular to the axis of the cylinder lock were already recognized earlier, and a different solution is shown by European Published Application No. 110,835. In this cylinder lock, actuated by a turning flat key, there is arranged on the outer jacket an electromagnet with a magnet anchor which runs parallel to the axis of the lock. The magnet anchor is provided, at its free end, with added devices which engage in a slide ring. This slide ring is fastened to an extension at the rear end of the rotor and is rotated with same. The electromagnet can be excited by means of an electric control. The blocking part sitting at the end of the anchor is brought into a position in which the slide ring is released for rotary movement. The solution represented here requires an extension of the cylinder lock in the axial direction which is undesirable in many cases. Moreover, the execution of double cylinder locks, in which two mechanical cylinders are combined with each other in the axial direction, is only possible with considerable expense. The axial dimensions of the lock must be changed from those of the known mechanical locks which, in turn, leads to difficulties in changing locks in existing doors and the like.

SUMMARY OF THE INVENTION

The problem of the present invention is to provide an electromechanical locking device in which a cylinder lock of the known kind can be used with mechanical holding devices. The electromagnet is arranged about parallel to the axis of the lock and the blocking pin engages in the rotor at right angles to the axis of the lock. Moreover, the blocking device is to be combined with the mechanical coding of the key. For the actuation of the magnetic coil, only a current pulse and no continuous actuation is necessary.

This problem is solved by the fact that the blocking device has a release bolt directed radial to the axis of the rotor, and a blocking bolt arranged parallel beside this release bolt and directed perpendicular to the axis of the rotor. An end surface of the release bolt lies against the sliding surface of a holding pin in the rotor positioned by the key. The release bolt engages through a carrier in the blocking bolt perpendicular to the release and blocking bolts. In its portion away from the rotor is arranged an electric switching element having a magnetic anchor with an electric coil. The magnetic anchor has at least one stop in which the blocking bolt engages. This arrangement, according to the invention, makes it possible to arrange the magnetic anchor with the electric coil parallel to the axis of the cylinder lock. In this way, the outer dimensions of the lock is kept small. The release and blocking bolts, arranged perpendicular to the axis of the lock, are in working connection with the magnetic anchor. The release bolt does not engage directly in the rotor, but rather, cooperates with a holding pin which is brought into the right position by the key inserted into the lock. Only with agreement of the mechanical coding on the key with this release bolt can the blocking bolt be released by the magnetic anchor, and thus releasing the rotary movement of the rotor in the stator housing. This arrangement makes possible an original safeguard against unauthorized intervention in the locking device, which is very important in combined electromechanical locks. This arrangement also effectively prevents unauthorized intervention in the blocking device by means acting on the lock from outside. Moreover, the space in the direction of the lengthwise axis of the cylinder lock is not taken up by the blocking device so that known mechanical rotor-stator arrangements can be used. Also, double cylinder locks could be combined in the known way. Also, the working connection between key and lock rotor and between lock and bolt can be produced in the known way, and no additional measures are needed to assure their safety and effectiveness. The turning on of the magnetic anchor through the electric coil takes place from an external control or an electronic device integrated into the lock. It will be apparent to the expert that equivalent solutions are possible, in which the magnet anchor is run out or drawn in by the magnet, or repelled or attracted by magnetic force.

A preferred form of execution of the invention is distinguished by the fact that the release bolt is forked at one end. The two tines of the fork part limit a space between them, and the magnet anchor is guided in this space. This arrangement permits a very compact construction while the magnet anchor is arranged at the least possible distance from the axis of the lock. Another improvement of the construction can be obtained by extending the tines beyond the magnet anchor to form a second space between them, and arranging in this space a pressure spring so that it presses the release bolt in the direction of the rotor.

Another preferred form of execution of the invention consists of arranging on the magnet anchor a spring set-back element which acts in the direction of movement of the anchor. This set-back element effects in each case, the return of the anchor and of the release bolt into the blocking position. In further development of the invention, the spring set-back element is designed like a lever and is provided with a turning point. One lever arm of the element lies against a carrier of the release bolt and the other lever arm of the element lies against a carrier on the magnet anchor. This arrangement means that the release bolt and the magnet anchor, although they move at right angles to each other, are forcibly joined together. The set-back element serves, in particular, to return the magnet anchor to its starting position when the magnet coil is without current.

In another development of the invention, the blocking bolt has a carrier shoulder against which lies, at the end of the blocking bolt directed toward the rotor, a pressure spring. The carrier shoulder of the blocking bolt lies against the carrier shoulder of the carrier of the release bolt. This arrangement assures a guiding of the blocking bolt, free of play, while it always remains in working connection with the release bolt. Since the two bolts are arranged parallel side-by-side, it is possible to bring the release bolt, with a holding pin in the rotor, into working connection. The blocking bolt acts as a rotor block, while on the outer jacket of the rotor is arranged a circular groove. This groove lies in the axis of the blocking bolt and extends on both sides of the normal position of the blocking bolt for a maximum of 90° of the circumference of the rotor in each case. Especially with reading and coding devices integrated into the lock, it is desirable if the rotor, with agreement of the mechanical holding device between lock and key, can be turned by a definite amount to assure the reading process between lock and key. With this, sufficient time is available to draw back the blocking bolt from the rotor before it is clamped by the walls of the groove and thereby a short backward movement becomes necessary to release the blocking bolt driven by a spring.

A further improvement of the possibilities of intervention of the blocking bolt in the magnet anchor can be reached by the fact that the stop against the magnet anchor is formed by a depression, and that the lower end of the blocking bolt is formed to fit this depression. A preferred form of execution of the invention consists, further, of the fact that on the magnet anchor in the switching direction before the depression, a groove with a pin is formed, and that on the lower end of the blocking bolt, a shoulder is present which cooperates with the pin. With a mechanical key inserted in, and correctly coded, the release bolt frees the movement of the blocking bolt. The blocking bolt is pressed by a spring against the magnet anchor, while the shoulder on the end of the blocking bolt engages in the depression with the pin (peg) of the groove on the magnet anchor. This groove forms only a slight depression on the jacket of the magnet anchor. The cooperation between the shoulder against the end of the blocking bolt and the pin on the magnet anchor holds the magnet anchor at its starting position. It is impossible, therefore, to bring the magnet anchor, through vibration or other actions from outside of the lock, into its switching position and thus to draw back the bolt from the rotor. This is only possible when the electromagnet is activated, and with this the magnet anchor is drawn by direct forceful action in the direction of the axis of the lock. With this, the shoulder at the end of the blocking bolt springs over the pin of the groove on the magnet anchor and lodges in the depression the magnet anchor which acts as a stop. Even with a currentless magnetic coil, now, the magnet anchor is held in its switching position, and the blocking bolt remains, based on the spring effect, outside the rotation zone of the rotor. Activations of the magnet coil take place, however, only when the information signals transmitted by the key to the lock were correct, and with this the electric control device releases the lock for actuation.

A further increase of security of the locking device can be obtained by building into the electrical conductor to the electric coil a microswitch. This microswitch has as switching element, a switching pin of which the end projects into the key channel against the rotor. In a further development of the invention, the microswitch includes a foil keyboard integrated into the conductor plate. In addition to the correct actuation of the release bolt through the respective holding pin for the release of the lock, the microswitch must also be actuated by the key. Otherwise, the electric control device remains without current and the blocking device is not released. The use of a foil keyboard, like those used for example in control consoles, makes possible a further reduction of the dimensions of construction and the integration of the switch into the rotor-stator portion of a known cylinder lock. Since only one switching element is needed, a single foil keyboard can be integrated into the conductor plate, which is built into the stator housing of the lock and bears the necessary electronic elements. All of the important electronic elements can be joined directly together on the conductor plate.

The electromechanical locking device according to the invention has very small measurements without limiting the desired high standard of safety of such locking devices. Despite the small dimensions, it has additional safety features which represent a considerable improvement over known locking devices.

BRIEF DESCRIPTION OF THE DRAWINGS

The invention will be explained in detail below from examples of execution with reference to the attached drawings.

DESCRIPTION OF A PREFERRED EMBODIMENT

Figure 1:
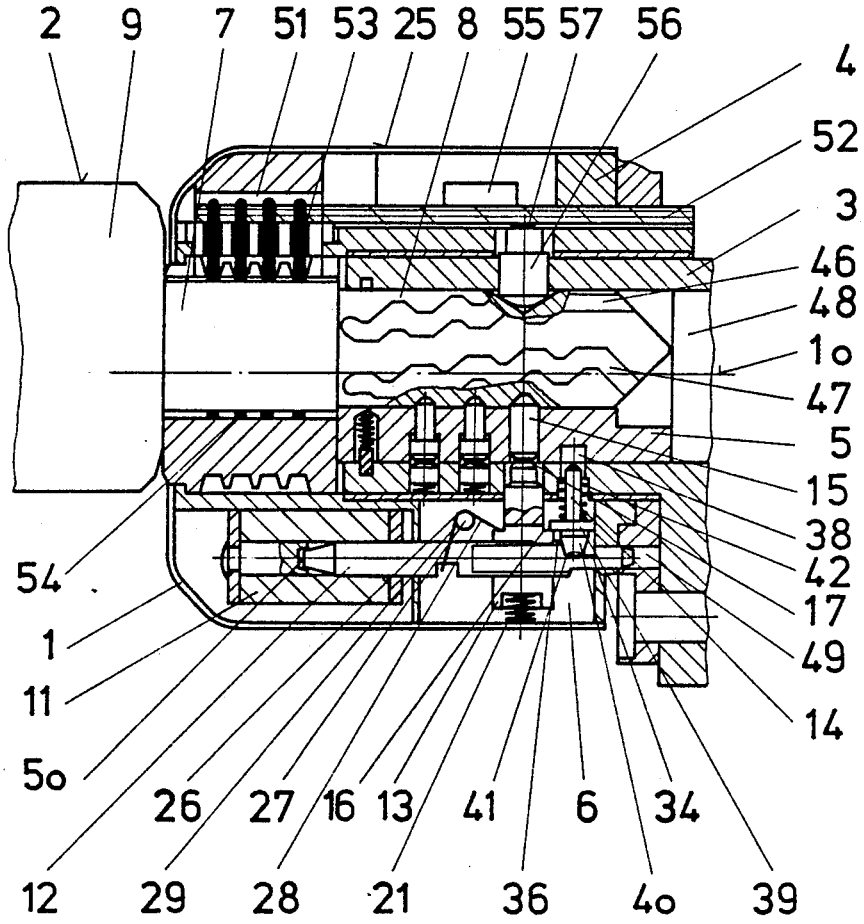
FIG. 1 shows a cylinder lock with electronic and mechanical coding and a blocking device, in longitudinal section.

The cylinder lock 1 shown in FIG. 1 contains both mechanical and electronic codings with the respective holding devices. Into the cylinder lock 1 is inserted a key 2 which includes a key barb 8, a contact portion 7 and a key barb portion 9. On the broad side of the key barb 8 are arranged grooves 46, 47 which cooperate with the mechanical holding devices, not shown. These holding devices, not shown, are supported in a rotor 5 which, in turn, can rotate in a stator 3. In the rotor 5 is arranged, also, a key channel in which the key barb portion 9 is conducted. Around the stator 3 is provided an additional stator housing 4 which receives the blocking device 6 and the contact device 51, with the corresponding electric and electronic connections and construction elements. The whole cylinder lock 1 is surrounded by an outer jacket 25.

In the key barb portion 9 of the key 2 are arranged electronic elements, such as a data memory, for example, which are connected by contact points 54 in the contact portion 7 of the key 2. These contact points 54 are on the narrow side of the key 2 and cooperate with slide springs 53. The slide springs 53 are fastened to a conductor plate 52, and are connected through electrical conductors with electronic elements 55 which are arranged on the conductor plate 52. Into the conductor plate 52 is integrated a foil keyboard 57 which is part of a microswitch 56. This microswitch 56 projects into the key channel and has inside it spring elements, not shown. The microswitch 56 may be activated directly through the narrow side of the key barb 8, or, as shown in FIG. 1, by means of an additional coding on the key 2. With the key 2 drawn out of the key channel 48, the microswitch 56 provides for interruption of the current circuit.

If the grooves 46 and 47 on the key barb 8 have the correct mechanical coding, the mechanical holding devices are in the opening position and the mechanical unlockings release the rotary movement of the rotor 5 in the stator 3. Since in this position, the key 2 is completely inserted, the slide springs 53 are in contact with the corresponding contact points 54 on the contact portion 7 of the key 2. Thus, through the contact device 51, information or data may be transmitted from the key 2 to the cylinder lock 1, or vice versa. The electronic elements 55 on the conductor plate 52, and any other electronic elements which are assigned to the cylinder lock 1 test the correctness of the information transmitted and determine whether the key 2 inserted in the cylinder lock 1 has been correctly entered. If the information transmitted is correct and agrees with the coding of the lock, the blocking device 6 is released.

Figure 2:
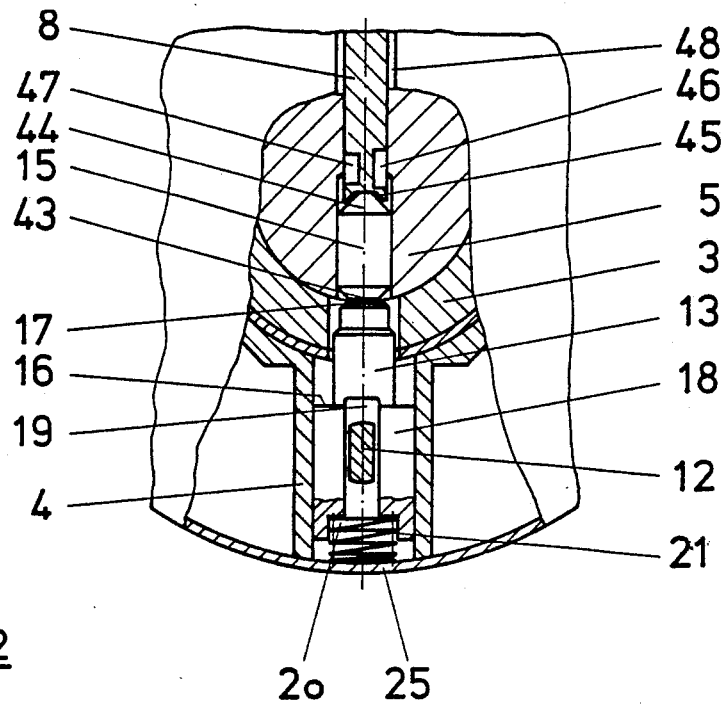
FIG. 2 is an enlarged partial section of a cross section through the lock according to FIG. 1, in the portion of the release bolt.

The blocking device 6 includes a release bolt 13 and a holding pin 15, a blocking bolt 14, a magnet anchor 12 and an electric coil 11. The release bolt 13 is arranged in the same axis as the holding pin 15, and is in a position perpendicular to the axis 10 of the lock 1. The cooperation between the holding pin 15, the release bolt 13 and the magnet anchor 12 can be seen especially in FIG. 2. The holding pin 15 is in a bore on the rotor 5, and engages by its tip 44 in an edge bore 45 on the narrow side of the key barb 8. At the other end of the holding pin 15 is a slide surface 43, which with a correctly positioned holding pin 15, coincides with the jacket surface of the rotor 5. Against this sliding surface 43 of the holding pin 15 lies an end surface 17 of the release bolt 13. The release bolt 13 has in its middle portion a carrier 16 and in the lower portion a forked part 18. The forked part 18 encloses a space 19 in which the magnet anchor 12 is guided. At the end of the forked part 18 is arranged a second space in which a pressure spring 21 is guided. This pressure spring 21 urges the release bolt 13, and thus the holding pin 15, in the direction of the rotor 5 or the axis 10 of the lock. When the edge bore 45 on the key barb 8 and the tip 44 on the holding pin 15 do not agree, the sliding surface 43 does not lie in the circumferential surface of the rotor 5, and the holding pin or the release bolt blocks rotary movement of the rotor 5 in the stator 3. Independently of the electronic coding, an additional mechanical blocking is herewith built into the lock.

On the carrier 16 of the release bolt 13 lies, on the upper surface, a carrier shoulder 39 of the blocking bolt 14. The blocking bolt 14 is supported in the stator 3, and engages by its end in a circular groove 38 on the rotor 5. This circular groove 38 extends over only a portion of the jacket (mantle) circumference of the rotor 5, and thus permits a partial rotary movement of the rotor 5 even when the blocking bolt 14 engages in the groove 38. Between the carrier shoulder 39 and the stator 3 is arranged a pressure spring 42 which urges the blocking bolt 14 away from the rotor 5. The lower end 40 of the blocking bolt 14 runs conical and has at the end surface a shoulder 41. This shoulder 41 cooperates with a pin 36 on the magnet anchor 12.

Figure 3:
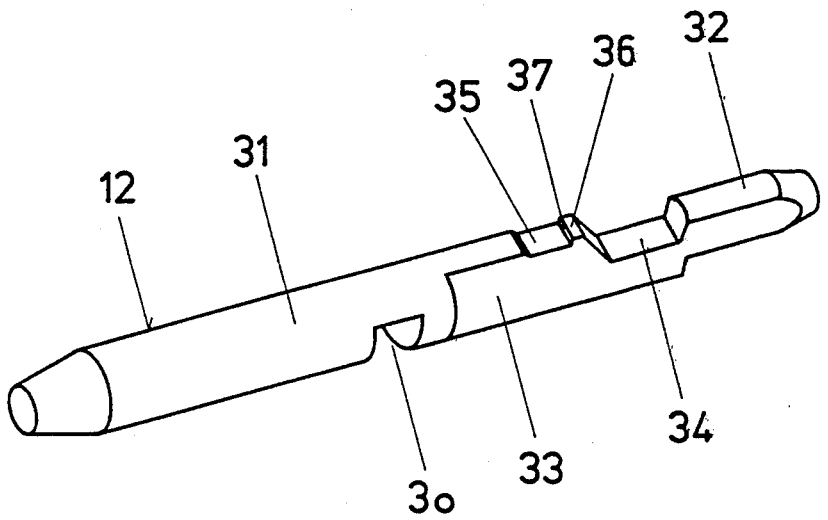
FIG. 3 shows the magnet anchor in perspective and on a larger scale.

As shown in FIG. 3, the magnet anchor 12 has a front part 31 and a rear part 32. The front part 31 is supported in the core bore 50 of the electric coil, and the rear part 32 in a bore 49 in the stator housing 4. In the rear part 32 of the magnet anchor 12, there is a stop in the form of a depression 34. This depression 34 is adjoined, in the direction of the front part 31 of the magnet anchor 12, by a groove 35. Between the groove 35 and the depression 34, the pin 36 is formed. This pin 36 has an oblique surface 37, of which the inclination is so chosen that the force of the electric coil suffices to push the shoulder 41 on the blocking bolt 14 over this oblique surface 37 of the pin 36. With this, the lower part 40 of the blocking bolt 14 is lodged in the depression 34 on the magnet anchor 12, and completely frees the groove 38 on the rotor 5. The magnet anchor 12 has also a carrier 30, in which, as shown in FIG. 1, a lever arm 29 of a set-back element 26 engages. This set-back element 26 is supported at the turning point 27 and has a second lever arm 28 which lies against the carrier 16 of the release bolt 13. The two lever arms 28 and 29 are designed springy so that between the magnet anchor 12 and the release bolt 13 here is an elastic working connection. To prevent rotation of the magnet anchor 12, parallel side surfaces 33 are present which are guided in the portion of the space 19 on the forked part 18 of the release bolt 13.

If no key 2 is in the cylinder lock 1, the release bolt 13 is urged by the spring 21, in the direction of the rotor 5, to an upper stop. The carrier 16 engages by its upper surface in the blocking bolt 14, while the lower surface of the carrier shoulder 39 of the blocking bolt 14 lies against the carrier 16 of the release bolt 13. With this, the blocking bolt 14 is pressed against the force of the spring 42 into the groove 38 on the rotor 5 and blocks the latter against full rotation. At the same time, the release bolt 13 presses the lever arm 28 of the set-back element 26, lying against the carrier 16, upward, and through the second lever arm 29, urges the magnet anchor 12 up to the stop in the bore 49. With this, the blocking device is in its normal starting position. Now if a key 2 is inserted into the cylinder lock 1, the mechanical holding devices, not shown, are pushed into their opening position so long as the key is correctly coded mechanically, and through the microswitch 56 the current circuit of the device for transmitting information signals is turned on. With this begins the exchange of the electronic information between the key 2 and the cylinder lock 1. If the electronic coding of the key 2 agrees with that of the cylinder lock 1, the blocking device 6 is released while the electric coil 11 is excited. At the same time with the positioning of the mechanical holding devices, the holding pin 15 with the release bolt 13, are also brought into the opening position. With this, the blocking bolt 14 is moved in the direction of the magnet anchor 12 until its lower end engages with the shoulder 41 in the groove 35 on the magnet anchor 12. Since the shoulder 41 on the blocking bolt 14 and the pin 36 on the magnet anchor 12 work opposite each other, the magnet anchor 12 first blocks the further movement of the blocking bolt 14. With this, the rotor can only be rotated as far as a corresponding groove 38 is arranged on the circumference. Should the electronic coding of the key 2 not agree with the lock 1, the rotor 5, even with agreement of the mechanical holding devices, cannot be turned completely, and thus, the lock cannot be opened. If the electronic coding of the key 2 agrees with that of the cylinder lock 1, then during the rotary movement of the rotor 5 with the aid of the key 2 in the portion of the ring groove 38, the electric coil 11 is activated through the electronic control and the magnet anchor 12 is drawn into the bore 50 of the core. The shoulder 41 on the blocking bolt 14 springs over the pin 36, and the lower end 40 lodges in the depression 34. Since the spring 42 presses the blocking bolt 14 against the magnet anchor 12, the feeding of current to the electric coil 11 can be interrupted at once, so that the current consumption of this device is extremely low. If the key 2 is drawn out of the cylinder lock 1 again, the microswitch 56 interrupts also the control current to the rest of the electric and electronic elements, which leads to increased electric safety and life of the current source.

Having described a preferred embodiment of the invention, the following is claimed:

1. An electromechanical locking device including a cylinder lock with a device for transmission of information signals between a lock and a key; a stator housing; a rotor rotatable in said housing; said rotor having an axis and a key channel to receive said key; holding means for mechanically blocking or releasing rotation of said rotor; and an electrically activated blocking device for controlling rotation of said rotor; the improvement comprising: said blocking device (6) having a release bolt (13) directed radially toward said rotor axis (10) and a blocking bolt (14) arranged parallel beside said release bolt (13), an end surface of said release bolt (13) lying against a sliding surface of a holding pin (15) positioned by said key (2) and guided in said rotor (5), said release bolt (13) engaging said blocking bolt (14) through a carrier (16) perpendicular to said release and blocking bolts (13, 14), and in their portions away from rotor (5) is arranged an electric switching element having a magnet anchor (12) with an electric coil (11), said magnet anchor (12) having at least one stop in which one end (40) of said blocking bolt (14) engages, the other end of said blocking bolt (14) engaging in a recess (38) in the rotor (5).

2. An electromechanical locking device according to claim 1, with the distinction that said release bolt (13) is forked at one end, the two tines (legs) of the forked part limit an interspace (19), and said magnet anchor (12) is guided in said interspace (19).

3. An electromechanical locking device according to claim 2, with the distinction that tines of the fork part (18) extend beyond said magnet anchor (12) to form a second interspace (20), and in said second interspace (20) a pressure spring (21) is so arranged that it presses said release bolt (13) in the direction of said rotor (5). anchor (12).

4. An electromechanical locking device according to claim 1, with the distinction that on said magnet anchor (12) is arranged a springy set-back element (26) acting in the direction of movement of said magnet anchor (12).

5. An electromechanical locking device according to claim 4, with the distinction that said springy set-back element (26) is designed like a lever, and is provided with a turning point (27), one lever arm (28) of said element (26) lying on a carrier (16) of said release bolt (13) and the other lever arm (29) of said element (26) lying on a carrier (30) on said magnet anchor (12).

6. An electromechanical locking device according to claim 1, with the distinction that said blocking bolt (14) has a carried shoulder (39), a pressure spring (42) on one end of said blocking bolt (14) directed toward said rotor (5), and said carrier (16) of said release bolt (13) lying against said carrier shoulder (39).

7. An electromechanical locking device according to claim 1, with the distinction that on the outer jacket of the rotor (5) is arranged a circular groove (38), said groove (38) lying in the axis of said blocking bolt (14) and extending on both sides of the normal position of said blocking bolt (14) over a maximum of 90°, in each case, of the circumference of said rotor (5).

8. An electromechanical locking device according to claim 1, with the distinction that the stop on said magnet anchor (12) is formed by a depression (34), and a part (40) of said blocking bolt (14) is formed to fit said depression (34).

9. An electromechanical locking device according to claim 1, with the distinction that a microswitch (56) is built into the feed line to said electric coil, and said microswitch (56) having a switch pin as a switching element of which the end projects into a key channel (48) of said rotor (5).

10. An electromechanical locking device according to claim 9, with the distinction that said microswitch (56) has a foil keyboard (57) integrated into a conductor plate (52).

11. An electromechanical locking device according to claim 8, with the distinction that on said magnet anchor (12) before said depression (34) (in the direction of switching movement) there is arranged a groove (35) with a pin (36), and at the lower end surface of said blocking bolt (14) there is a shoulder (41) which cooperates with said pin (36).

12. An electromechanical locking device comprising a cylinder lock including a stator; a rotor having an axis and a kay channel, said rotor being rotatable about said axis in said stator; and rotor control means including mechanical means for locking and unlocking rotation of said rotor and electrical means for controlling rotation of said rotor; the improvement wherein said rotor control means comprises:

a release bolt perpendicular to said axis and shiftable radially with respect to said axis, said release bolt having an engagement surface and a carrier element;

a holding pin perpendicular to said axis and shiftable radially with respect to said axis, said holding pin having an inner end surface and an outer engagement surface engaged with said engagement surface of said release bolt for radial movement therewith;

means for biasing said holding pin through said release bolt toward a radial position with said inner end surface in said key channel;

a blocking bolt perpendicular to said axis and shiftable radially with respect to said axis between a first radial position inhibiting rotation of said rotor and a second radial position not inhibiting rotation of said rotor;

means for biasing said blocking bolt toward said second radial position;

an anchor member parallel to said axis and shiftable axially with respect to said axis between a first axial position blocking movement of said blocking bolt toward said second radial position and a second axial position not blocking movement of said blocking bolt toward said second radial position; and, electrical means for shifting said anchor into said second axial position.

13. The improvement defined in claim 12 wherein said engagement surface of said release bolt is a radially inner end surface; and said outer engagement surface of said holding pin is a radially outer end surface abutting against said radially inner surface of said release bolt.

14. The improvement defined in claim 13 further included mechanical means for shifting said anchor back from said second axial position toward said first axial position.

15. The improvement defined in claim 14 wherein said mechanical means includes a lever acting between said release bolt and said anchor to move said anchor as said release bolt moves radially toward said axis.

16. The improvement defined in claim 15 wherein said anchor includes a recess in which said outer end of said blocking bolt fits when in said second radial position.

17. The improvement defined in claim 16 wherein said blocking bolt has an outer end and a shoulder element engagable with said carrier element of said release bolt for radial movement therewith toward said axis.

* * * * *

UNITED STATES PATENT AND TRADEMARK OFFICE

CERTIFICATE OF CORRECTION

PATENT NO. : 4,939,915

DATED : July 10, 1990

INVENTOR(S) : Benno Vonlanthen

It is certified that error appears in the above-identified patent and that said Letters Patent is hereby corrected as shown below:

Column 8, Line 14, Claim 3, delete "anchor (12).".

Column 8, Line 33, Claim 7, insert --(mantle)-- after "jacket".

Column 8, Line 63, Claim 12, change "kay" to --key--.

Signed and Sealed this

Fifteenth Day of October, 1991

*Attest:*

HARRY F. MANBECK, JR.

*Attesting Officer*

*Commissioner of Patents and Trademarks*